United States Patent [19]

Opdahl et al.

[11] 3,969,977

[45] July 20, 1976

[54] HULL MODULE WEAPON OR EQUIPMENT SYSTEM

[75] Inventors: Everett W. Opdahl, Lutherville; Chang K. Kim, Serverna Park, both of Mo.

[73] Assignee: The United States of America as represented by the Secretary of the Navy, Washington, D.C.

[22] Filed: Apr. 16, 1974

[21] Appl. No.: 461,466

[52] U.S. Cl. ..... 89/1.810; 89/5; 114/16 R

[51] Int. Cl.[2] ..... F41F 3/10

[58] Field of Search ..... 89/1.5 R, 1.5 H, 1.5 C, 89/5, 1.809, 1.810; 114/20 R, 16 R

[56] References Cited

UNITED STATES PATENTS

| | | | |
|---|---|---|---|
| 1,356,294 | 10/1920 | Kuhajda | 80/5 |
| 2,921,501 | 1/1960 | Parot | 89/1.5 R |
| 3,368,510 | 2/1968 | Humphrey | 114/16 R |

*Primary Examiner*—Samuel W. Engle
*Assistant Examiner*—S. A. Cangialosi
*Attorney, Agent, or Firm*—R. S. Sciascia; L. I. Shrago; C. E. Vautrain, Jr.

[57] ABSTRACT

A method of and means for installing weapons and associated launch gear or other equipment in positions external to a submarine pressure or other vessel hull are provided. The lateral outer cross section of the submarine preferably is divided into quadrants and a replenishible weapon or equipment cartridge or module is lowered into each individual quadrant. Each module preferably contains a plurality of payloads, and after all of the payloads have been expended the expired module is easily removed and replaced by a loaded one.

12 Claims, 7 Drawing Figures

HULL MODULE WEAPON OR EQUIPMENT SYSTEM

This invention concerns weapons deployment and replenishment and, more particularly, a system for mounting weapons or equipment and associated gear in cartridges deployed externally of a submarine pressure hull.

Conventionally, submarines have employed a weapons system which was predicated on stowing weapons inside the pressure hull and launching the weapons through an isolated lockout chamber. For structural simplicity and initial weapon guidance, a cylindrical tube was the natural selection for the lockout chamber and, of course, an equally natural selection for the cylindrical shape of the vehicle to be expelled therefrom.

This approach of storing and launching from within the pressure hull was desirable for several reasons some of which are the absence of large sonar domes which permitted the launch tubes to be located near the bow section and parallel to the ship centerline, the necessary penetrations in the pressure hulls designed for shallow depths which did not present a severe structural problem, and a launch noise which was acceptable to the general operational concept. Technology was not sufficiently advanced to permit long term exposure of weapons to the sea environment, and weapons were simple enough in nature to permit maintenance and repair on board by ship personnel. Also, the required weapon performance could be achieved within the constraining envelope of the internally disposed launch tubes.

The evolution of submarines and their weapons systems has removed or diminished the significance of the above noted advantages of the internally stored and launched weapons. In accordance with present advances, torpedoes tubes are now being located somewhat aft of the bow of the submarine and canted outboard to permit firing past the large sonar domes now required for search and tracking procedures. Hydrodynamic forces acting on the weapons while exiting from such relocated and canted tubes tend to rotate the weapons thereby causing possible weapon hangup and/or damage to the tail of the submarine. This possible damage or hangup can be minimized by restricting ship speed during launch and/or by the use of an impulse launch to reduce the transitional time period. This reduced launch speed involves an undesirable compromise of operational capability, and the impulse launch results in undesirably high noise levels with a consequent susceptibility to detection by the enemy.

Weapon pereformance requirements have increased to the point where today the use of existing torpedo tubes presents a severe constraint on weapon design. Because of the diameter and volume constraint of the launch tube, torpedo hydrodynamic shapes cannot be optimized from a performance standpoint. Protruding appendages such as wings or tails, which may be desirable to optimize performance, are not compatible with present limited tube diameters and impulse launch techniques. Optimization of the body shape can be achieved by enlargement of the torpedo tube diameter, however, this makes the hull structural penetration design problem more difficult especially where deeper submarine operating depths are available. Enlargement of the torpedo tube diameter appears to be mandatory if consideration is given for its use in launching airborne missiles. A larger tube diameter does not, however, completely solve the problem of launch of weapons with protruding appendages unless a fall-away weapon adapter is employed or appendages are extended after launch.

Accessibility of weapons for check-out and servicing is no longer advantageous in view of the latest advances in weapon sophistication which preclude, among other things, repair by shipboard personnel with limited training and facilities, a requirement that preflight check-out be made after insertion in and flooding of the torpedo tube, and a condition wherein propulsion motor malfunction cannot be determined until the weapon is launched.

Although internally stowed weapons are subjected to a less severe environment prior to launch, the same capability can be achieved by externally positioning and encapsulating the weapon. In the case of airborne missiles, encapsulation removes the hydrostatic pressure load and, therefore, permits design of a missile whose weight is low enough to assure reasonable performance. Thus, the advantages formerly associated with a weapon system utilizing the interior of the pressure hull for stowage have become less important. It is now apparent that a system providing for submarine weapon launching from outside the confines of the pressure hull is not only advantageous but desirable. The present invention overcomes the deficiencies of internal stowing and launching of weapons as well as equipment from submarines by providing a submarine weapon launching system which is located entirely outside of the confines of the pressure hull.

According to the present invention, an external stowage system which is adapted for either launch of weapons such as torpedoes and missiles or housing of equipment such as sonar gear and external electronics packages is provided. The elements to be stowed and launched are combined into a plurality of modules each of which preferably occupies a quadrant of a toroidal volume surrounding the submarine pressure hull. This module arrangement is also adapted for installation in the superstructure of a submarine or surface vessel. The modules require no feed mechanisms since each weapon is provided with independent launch equipment. Superstructure modules can, of course, be replaced easily at dockside but are not generally applicable for use with torpedoes. Quadrant modules are lowered into hull recesses, with topside modules coupled along the center of the deck and bottom modules coupled along the center of the underbody of the vessel. After coupling, the modules are either lowered or raised, respectively, into hull recesses, positioned, and thereafter locked in place and snubbed up. Electrical and hydraulic lines as required are routed topside during installation. The weapons or equipment preferably are contained in individual capsules and are adapted to be individually streamed from the recessed position by a folded mechanism. Expended modules are quickly replaced by pre-assembled and tested loaded modules.

Accordingly, it is an object of the present invention to provide a system for accomplishing the external launching of weapons and equipment from submarines.

Another object of this invention is to provide an external weapon launcher which is adapted to both torpedoes and missiles and to a variety of launch techniques.

A further object of this invention is to provide an external weapon launcher which is simple in operation and rugged in construction so that weapons and/or missiles may be individually and readily launched from recesses in the external submarine hull.

Other objects, advantages and novel features of the present invention will become apparent from the following detailed description thereof when considered in conjunction with the accompanying drawings in which like numerals represent like parts throughout and wherein.

Figure 1:
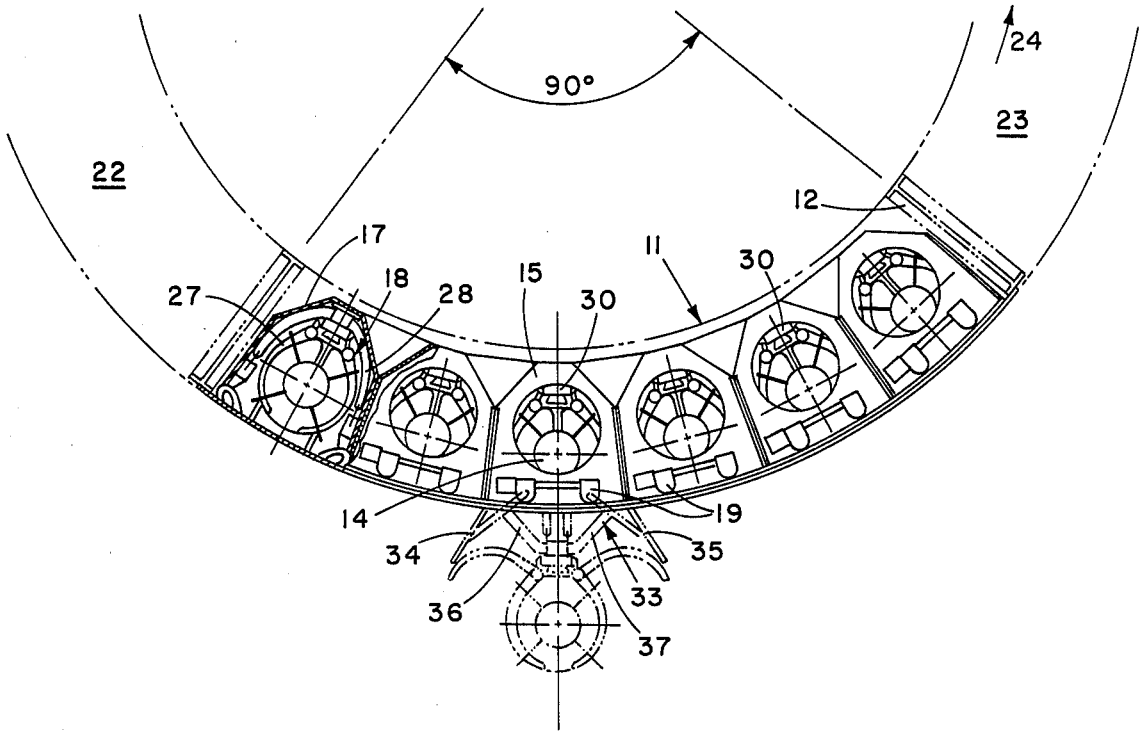
FIG. 1 is a side elevation partly in section of a weapon or equipment module illustrating the arrangement and deployment therein of a plurality of encapsulated torpedoes.

Referring to FIG. 1, an external weapon or equipment launcher 11 is shown which is in effect a module containing six weapons each housed in a separate support structure with the entire module received in a hull recess envelope 12. One of the weapons, in this instance a torpedo 14, is carried in a capsule 15 and is shown in both the housed and streamed positions. Each of the weapons is independent from the carrying ship's systems to the fullest extent, the weapons being connected only to circuits which control the actuation of the streaming mechanism and the arming and launching of the weapon. The weapons launch system in module 11 is configured in what may be termed as a building-block arrangement which permits tailoring the needs of any given weapon such as a separate and independent launch aperture and system to that weapon.

The supporting structures and mechanisms required in the modular concept of this invention generally include a supporting structure, a launch transient guide, a feed mechanism, a launch aperture, a streaming gear and a release mechanism. Details of these various components will be described infra.

Figure 5:
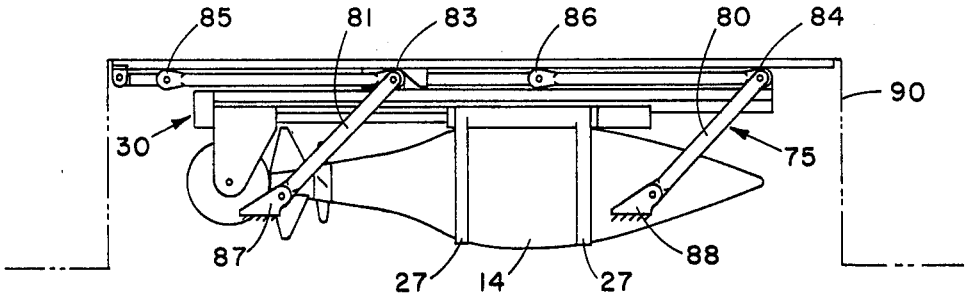
FIG. 5 is an enlarged front elevation view of a torpedo in the stowed position in a hull recess.
Figure 6:
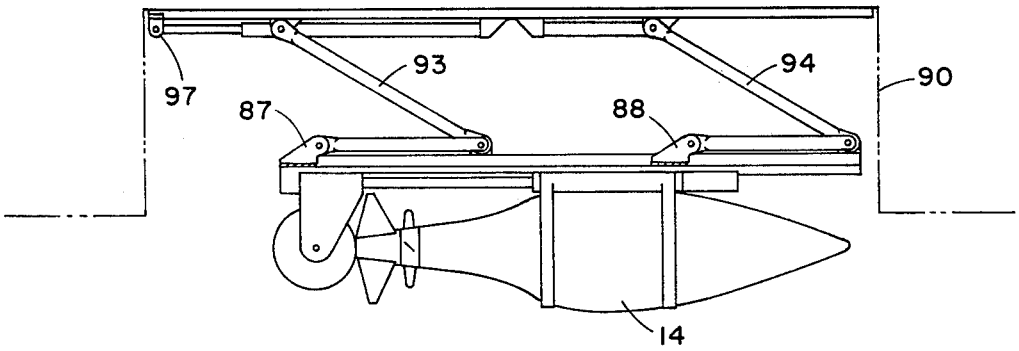
FIG. 6 shows the torpedo of FIG. 5 in a partially streamed position.
Figure 7:
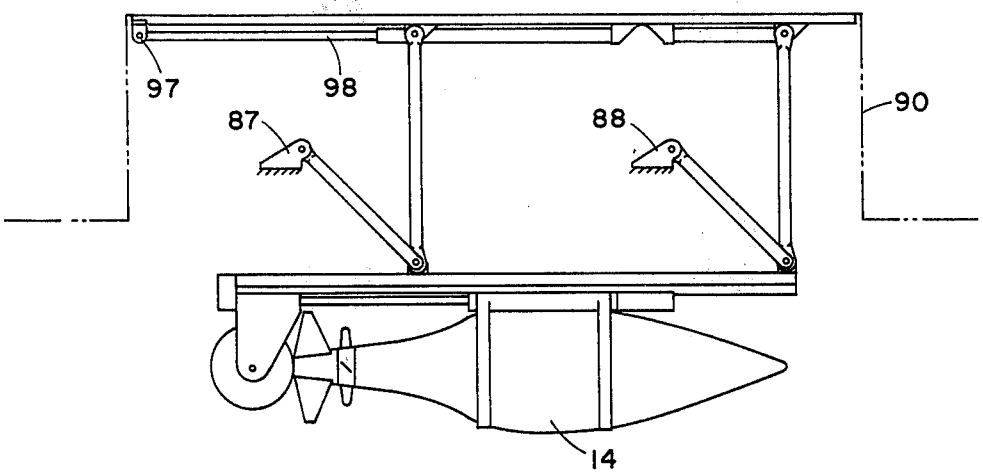
FIG. 7 shows the torpedo of FIG. 5 in the fully streamed position.

Module 11 contains a plurality of individual weapons such as torpedo 14 in individual capsules such as 15 and includes for each capsule a support structure 17, a streaming gear 18, and a door operating mechanism 19. The pressure hull of the submarine carrying module 11 is indicated at 21, and a plurality of modules are disposed about the hull in additional recesses indicated at 22, 23 and 24. Where necessary, the weqpons or equipment may be secured by a pair of articulate arms 27 and 28 which substantially encircle and grip the weapon or equipment. Additional pairs of arms may be employed as necessary for securing exceedingly heavy and/or long weapons or equipment. A launch transient guide 30 preferably is employed to permit forward and aft movement of the missile during streaming thereof. A launch aperture and its associated mechanisms is shown at 33 and may consist of a pair of folding doors 34 and 35 which are connected to collapsible arms 36 and 37 which in turn are connected to the door operating mechanism 19. FIGS. 5–7 illustrate in greater detail some of the foregoing components and the manner in which they cooperate to stream a weapon from the retracted or stored position.

Figure 2:
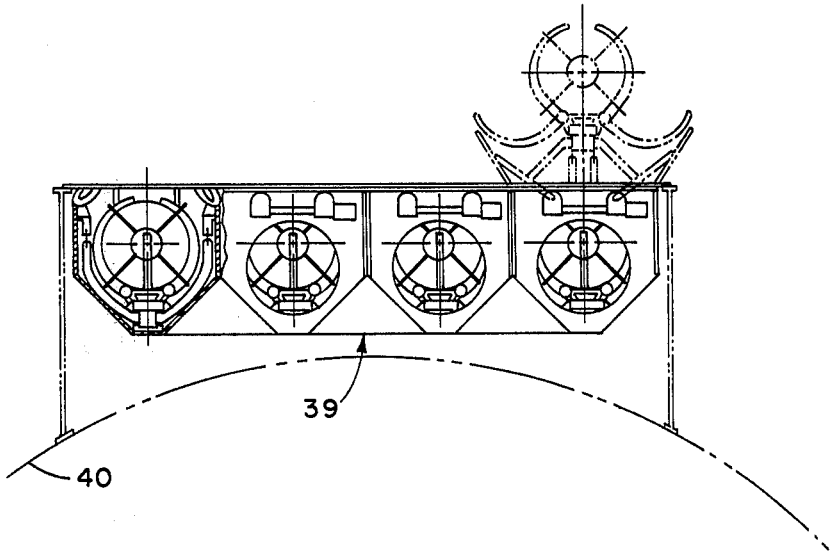
FIG. 2 is a side elevation partly in section of a missile module for deck or superstructure installation.

FIG. 2 illustrates a module 39 of four weapons such as missiles which is adapted to be carried on the deck of a submarine 40 or a surface vessel. The details of the supporting structure, launch transient guide, launch aperture, streaming gear and release mechanisms in the deck module are substantially identical to those of the external hull module.

Figure 3:
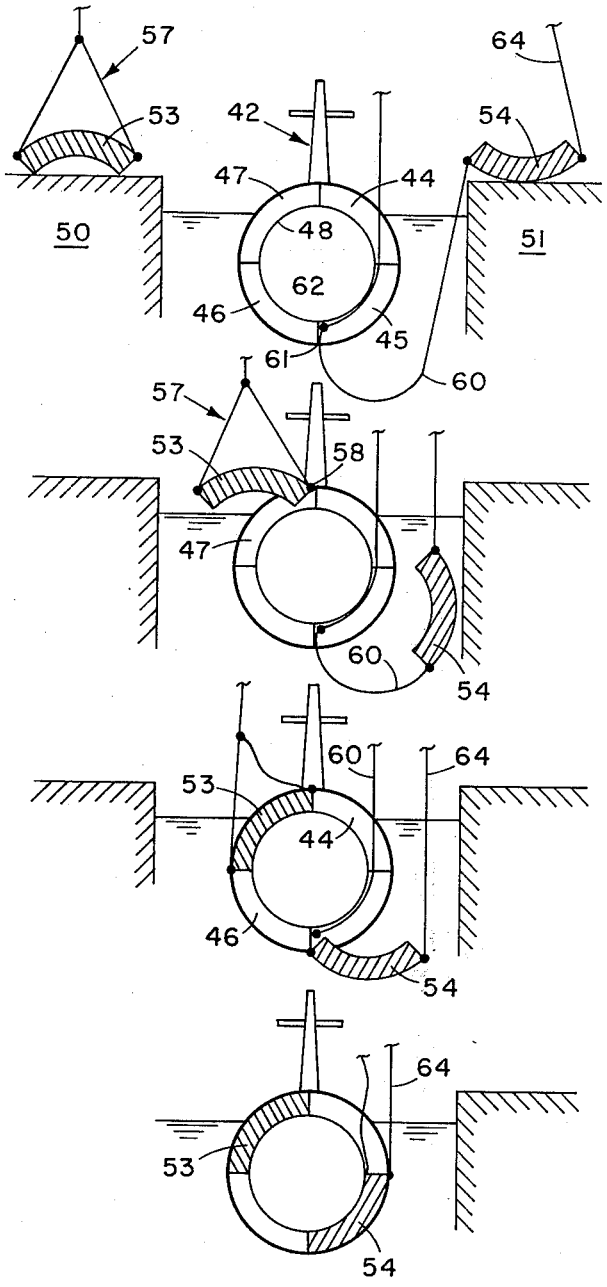
FIGS. 3 and 4 are schematic illustrations of the placement of external weapon or equipment modules about the hull of a submarine.
Figure 4:
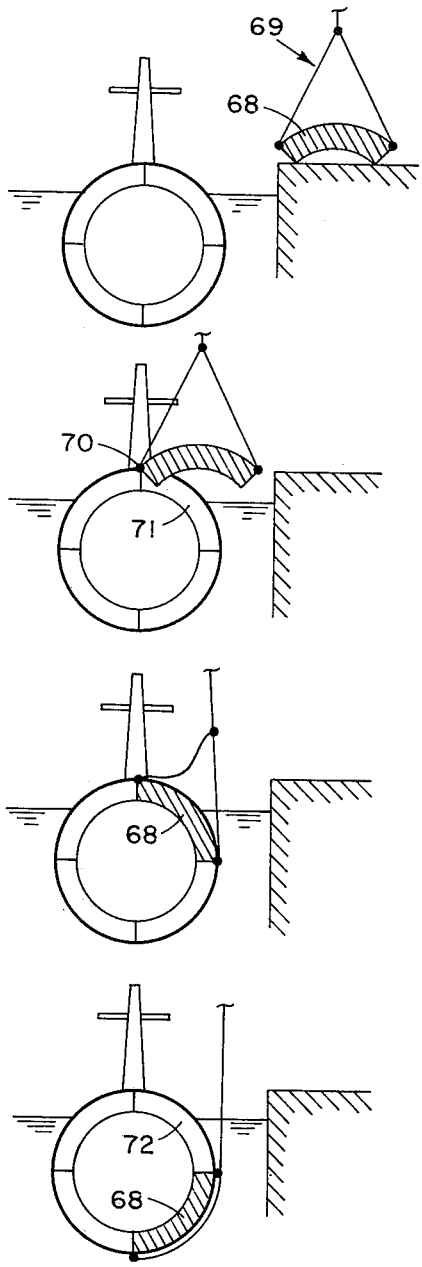

FIGS. 3 and 4 show a submarine 42 having a plurality of hull recesses 44–47 circumferentially disposed about the submarine's pressure hull which is indicated at 48. For convenience, the submarine is shown positioned between opposite loading platforms 50 and 51 on which weapon or equipment modules 53 and 54 are placed. The modules at this stage contain weapons or equipment in capsules, not shown, and are in condition to be installed in the respective hull recesses. It will be appreciated that such installation may readily be accomplished from a single loading area or pier. Module 53 is hoisted by means of a bridle 57 and a crane or other cargo handling means, not shown, transported to a position over its recess 47, coupled to the submarine by conventional means indicated at 58, and then lowered into the recess and latched in place. On the opposite side of submarine 42, module 54 is tethered to the underbody of the submarine by a tether 60 which passes through a pair of guides 61 and 62 and thereafter is brought to the hoisting crane. Module 54 is raised by a cable 64, lowered into the water alongside the submarine to a selected depth and then coupled into position in recess 45 by hauling in on tether 60 until mechanical coupling to the submarine is effected. At this point, cable 64 is hauled in until module 54 is nested in recess 45 and thereafter is latched therein by conventional means, not shown.

In FIG. 4, an alternate method of installing the lower quadrant modules is shown wherein a module 68 is raised by a bridle 69, transported to the submarine and coupled at 70 thereto. Module 68 is then lowered into recess 71 and after being nested in place, the hull recess envelope, not shown, receiving module 68 is rotated 90° clockwise until module 68 is in position in the lower quadrant on that side of the sub marine at which time it is latched in place. Quadrant 72 above module 68 may now receive a module in the manner described in connection with the positioning of module 53.

FIG. 5 illustrates a streaming gear mechanism for use with encapsulated weapons or equipment which permits stowage of the weapon and gear in a minimum of space while providing the necessary structural support when deployed. A parallelogram type streaming gear mechanism 75 is shown that includes forward and aft U-shaped yokes 80 and 81 which pivotally couple launch transient guide 30 to the launcher structure at points 83–84 and 85–86 abd to the submarine at points 87–88. These yokes rotate together to move the load from a horizontal attitude in a hull recess 90 to a horizontal attitude in the flow stream as shown in FIGS. 5 and 6. Yoke motion is controlled by drive links 93–94 which have one end coupled to the launch transient guide and the other end coupled to a hydraulic actuating cylinder. The actuating cylinder is fixed to the launcher structure at 97 at one end while the other end moves in a guide 98 fixed to the launcher structure. As the hydraulic actuator is extended, the ends 85 and 86 of the drive links coupled to the actuator are forced forward, causing the yoke to rotate clockwise from the position shown in FIG. 5 through the position shown in FIG. 6 to the position shown in FIG. 7. When the actuator is fully extended, the drive links are locked in a vertical position wherein the yokes are at the end of their angular travel and the weapon is fully streamed. Retraction of the hydraulic cylinder reverses the process. The gear is retained in the stowed position by a locking means, not shown, on the hydraulic cylinder.

It will be appreciated that although only one form of launching and streaming mechanism has been shown, other launching systems may be employed as determined by needs of a particular weapon or other payload. Also, the modules may be arranged for carrying weapons which do not require pre-launch streaming such as torpedoes which may be fired directly from a module base. In any launch system, it would appear necessary to have a support structure and a release mechanism as a minimum of launching equipment. A further modification would be that of a torpedo in a casing wherein the casing may be opened at the forward end and is retained when the torpedo is launched.

The modules shown herein permit each weapon or payload to be launched independently of others in a module or among modules with the exception that folding doors such as 34 and 35 prevent the simultaneous use of adjacent launch mechanisms. In modules carrying protected weapons, the individual capsules are flooded in underwater locations and not sealed from the environment in above water locations so that the missiles or other payloads are always in the environment in which they are to be launched.

The use of the modularized external weapon or equipment launchers of the present invention provides a means for weapon replenishment which was not heretofore possible. Individual weapons may be loaded into the modules at a depot or servicing area where the modules also may be checked-out so as to be in immediate readiness for dockside installation. The modules may be positioned about a submarine as shown in FIGS. 3 and 4 or may be similarly positioned in variations of the systems disclosed. After positioning, the modules are locked in place and snubbed up. Electrical and hydraulic lines are routed topside during installation and connected to a common junction above the water line to complete the module installation.

The present invention, therefore, permits depot replenishment and check-out of weapon/launcher systems prior to shipboard installation, reducing weapon handling damage to a minimum. Depot refurbishment and maintenance of the launch mechanisms also may be routinely accomplished, and revisions to the launch systems may be effected with minimum impact on the ship. Non-weapon modules may be employed for special situations and equipment such as sonar gear, external electronics, etc.

Obviously, many modifications and variations of the present invention are possible in the light of the above teachings thereof.

What is claimed is:

1. The combination with the double hulls of a submarine of exteriorly disposed launchable payloads comprising:

a unitary payload module including a plurality of individual capsules and a payload in each capsule, said module occupying and secured in recesses between the double hulls of a submarine;

each of said capsules containing combined means for storing and deploying the payload therein; and control means connecting said capsules to a central control in the submarine so that said payloads may be remotely and selectively deployed and launched.

2. The payload module of claim 1 wherein a plurality of said modules are disposed about the periphery of one or more longitudinal sections of the hull of the submarine;

the recesses in said sections being quadrants of the periphery of the pressure hull, said modules encircling the pressure hull and extending radially therefrom to the periphery of the outer hull of submarine so as to form a continuous surface with the outer hull.

3. The payload modules of claim 2 wherein said payloads are operationally self-contained and said modules are readily accessible for reloading and repair so that the payloads and the modules may be assembled, checked and otherwise prepared at a shore or depot installation, said payloads ready for deployment and launching when said modules are secured in their respective recesses and are connected to the control station of said submarine.

4. The payload module of claim 3 wherein said payloads are weapons and said deploying means include folding mechanical means for moving said weapons from the stored position to a streamed position in the environment.

5. The payload modules of claim 4 wherein said payloads are equipment and said deploying means include folding mechanical means for removing said equipment from the stored position to a streamed position in the environment.

6. The method of deploying and launching missiles, torpedoes or other payloads from positions exterior to the pressure hull of a submarine comprising:

mounting a plurality of payloads in arcuate payload modules adapted to conform to portions of said pressure hull;

coupling the payload modules to the pressure hull in recesses which occupy the space between the pressure hull and the outer hull along selected sections of the pressure hull so that the outer surfaces of the modules conform to the outer hull of the submarine;

latching the modules in place; and connecting the payloads to a control station in the submarine.

7. The method as defined in claim 6 and further including deploying selected payloads from the modules such that the deployed payload is extended into the environment in a launch attitude; and launching the deployed payload from the extended position, whereby a plurality of payloads may be carried in a lesser plurality of modules and after the payloads have been expended the modules may be reloaded and reinstalled in the appropriate recesses.

8. The method as defined in claim 7 wherein the hull recesses occupy quadrants of hull sections between the pressure and outer hulls and the modules for the upper quadrants are first coupled to the submarine along the centerline of the upper hull surface and thereafter lowered into place about the pressure hull and secured; and the modules for the lower quadrants are lowered to a point opposite the bottom of the submarine, coupled along the bottom centerline, and thereafter hauled into place by raising the outer end thereof and securing that end to the submarine.

9. The method as defined in claim 8 wherein the lower modules are initially secured in an upper quadrant and thereafter are rotated about the pressure hull to their final position in a lower quadrant.

10. The method as defined in claim 9 wherein the payloads are mounted in unfoldable carriages in the modules and are exposed to the launch environment prior to and during deployment thereof.

11. The method as defined in claim 7 wherein the modules are planar in shape and are secured in a support structure mounted on a submarine.

12. The method as defined in claim 11 wherein the payloads are mounted in unfoldable carriages in the modules and are exposed to the launch environment prior to and during deployment thereof.

* * * * *